United States Patent [19]

Ito

[11] Patent Number: 4,768,295

[45] Date of Patent: Sep. 6, 1988

[54] SOLE

[75] Inventor: Masafumi Ito, Kobe, Japan

[73] Assignee: Asics Corporation, Kobe, Japan

[21] Appl. No.: 120,761

[22] Filed: Nov. 16, 1987

Related U.S. Application Data

[63] Continuation of Ser. No. 871,224, Jun. 6, 1986, abandoned.

[30] Foreign Application Priority Data

Apr. 11, 1986 [JP] Japan ..... 61-55201

[51] Int. Cl.[4] ..... A43B 13/20; A43B 21/26

[52] U.S. Cl. ..... 36/28; 36/29

[58] Field of Search ..... 36/28, 29, 3 B, 88, 36/93, 35 R

[56] References Cited

U.S. PATENT DOCUMENTS

| | | | |
|---|---|---|---|
| 836,364 | 11/1906 | Busby | 36/29 |
| 3,795,994 | 3/1974 | Ava | 36/29 |
| 4,100,686 | 7/1978 | Sgarlato et al. | 36/29 |
| 4,211,236 | 7/1980 | Krinsky | 128/594 |
| 4,227,320 | 10/1980 | Borgeas | 36/88 |
| 4,423,735 | 1/1984 | Comparetto | 36/28 |
| 4,458,430 | 7/1984 | Peterson | 36/28 |
| 4,471,538 | 9/1984 | Pomeranz et al. | 36/28 |
| 4,472,890 | 9/1984 | Gilbert | 36/28 |
| 4,506,460 | 3/1985 | Rudy | 36/28 |
| 4,567,677 | 2/1986 | Zona | 36/28 |

FOREIGN PATENT DOCUMENTS

| | | | |
|---|---|---|---|
| 341490 | 8/1904 | France | 36/29 |
| 18341 | of 1895 | United Kingdom | 36/29 |

*Primary Examiner*—Steven N. Meyers

*Attorney, Agent, or Firm*—Armstrong, Nikaido, Marmelstein & Kubovcik

[57] ABSTRACT

A sole for sports shoes is proposed which has improved shock absorbing capability when landing, and provides a repulsion force when kicking. Cushioning members are mounted in the recesses formed in the sole plate. Each cushioning member has a pair of sheets adhered together at spacings to form a plurality of chambers. The chambers are filled with a gel to inflate them. Air chambers are formed between the gel filling chambers.

4 Claims, 2 Drawing Sheets

SOLE

This application is a continuation of application Ser. No. 871,224, filed June 16, 1986, abandoned.

The present invention relates to a sole for sports shoes or the like.

A sole for sports shoes is required to have a good shock absorbing capability to protect the foot from shock applied thereto upon landing.

A sole has been proposed which has a sole plate formed with a recess e.g. at its heel portion, the recess being filled with a gel. When shock is applied to the heel portion of the shoes, the gel undergoes a non-elastic deformation due to its energy propagation characteristic similar to that of a liquid, thus absorbig the shock instantly.

One disadvantage of such a conventional sole is that if shocks are applied repeatedly at short intervals as during running, the shock absorbing capability decreases because the next shock is applied before the deformed gel comes back to its original state, and because the gel in the recess displaces to one side.

One requirement for the sole is to absorb shock in order to protect the foot upon each landing. But, this is not sufficient. Another requirement is to transform the absorbed kinetic energy to a repulsion force when kicking the ground. Otherwise the kinetic energy would be lost. Thus, it is required that a sole can store the kinetic energy applied thereto upon landing and take it out as a repulsion force when kicking.

The abovesaid conventional sole has a disadvantage that the kinetic energy absorbed by the gel does not function as a repulsion force, inspite of the fact that it can absorb the shock due to the fluidity of the gel.

An object of the present invention is to provide an improved sole which does not impair in its shock absorbing property even if shocks are repeatedly applied, and which can provide a sufficient repulsion force when kicking.

In accordance with the present invention, there is provided a sole comprising a sole plate formed with a recess, and a cushioning member having a pair of sheets adhered together at spacings to form a plurality of gel filled chambers, said gel filled chambers being filled with a gel to inflate it, said recess being of a depth substantially equal to the thickness of said gel filled chamber, said cushioning member being received in said recess in said sole plate.

With the sole according to the present invention, when shock is applied to its sole plate, it is transmitted to the gel in the filled chambers in the cushioning member and is absorbed by the gel which deforms non-elastically. Since the gel is filled in a plurality of filled chambers separate from each other and it flows in different ways in different filled chambers, all the gel will not displace in the same one direction. Thus, even if shocks are applied repeatedly as during running, the shock absorbing capability will not decrease.

The filled chambers in the cushioning member are inflated by filling the gel therein. Thus, when the cushioning member is put in the recess formed in the sole plate, air chambers are formed between the filled chambers and the bottom of the recess. The air in the air chambers is compressed as the sole plate and the cushioning member are deformed by shock upon landing. The pressure of the compressed air functions as a repulsion force when kicking.

Due to the fact that the filled chambers are formed by partially adhering a pair of sheets together, the adhered portions containing no gel are highly flexible. Thus, the incorporation of cushioning members in the sole plate will not decrease the flexibility of the sole plate in any way.

Other objects and features of the present invention will become apparent from the following description taken with reference to the accompanying drawings, in which.

The sole according to the present invention comprises a sole plate 3 formed with recesses 4 and cushioning members 1 filled with a gel 2 and received in the respective recesses 4.

Figure 1:
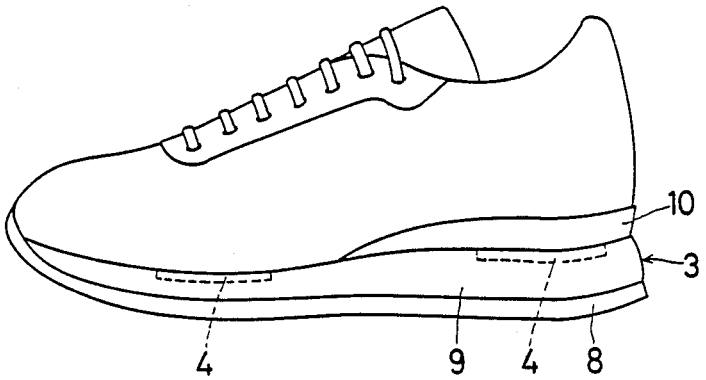
FIG. 1 is a side view of shoes provided with the sole embodying the present invention.
Figure 2:
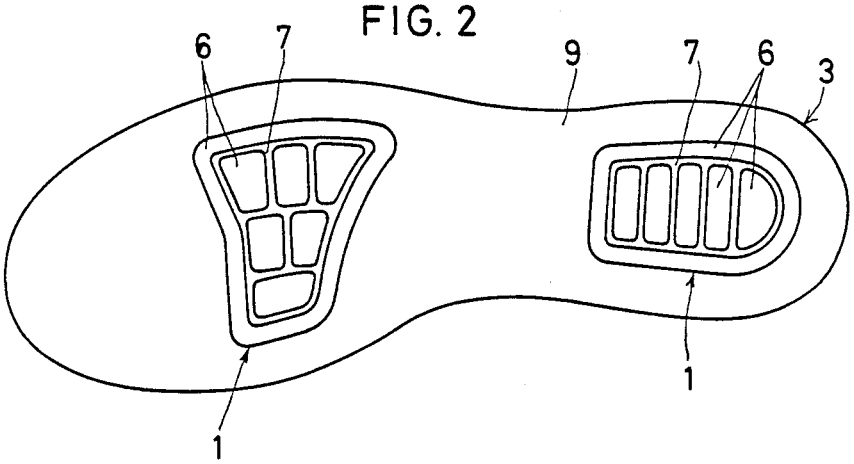
FIG. 2 is a plan view of the middle sole in which the cushioning members are mounted.
Figure 3:
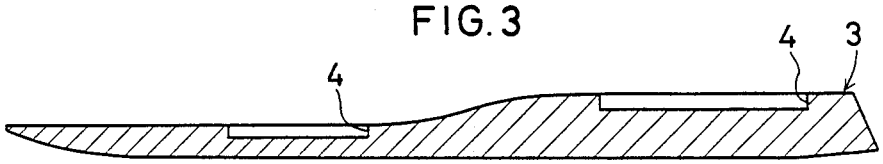
FIG. 3 is a sectional view of the middle sole.
Figure 4:
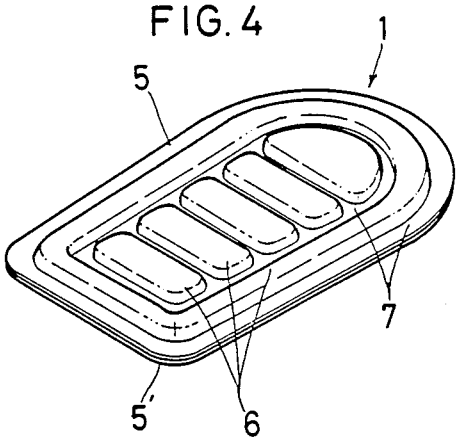
FIG. 4 is a perspective view of an example of the cushioning member.
Figure 5:
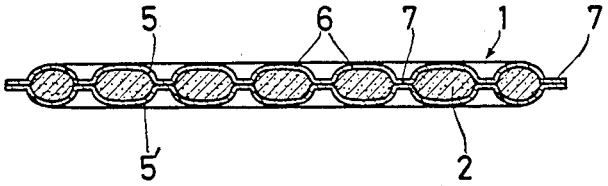
FIG. 5 is a sectional view of the cushioning member of FIG. 4.

As shown in FIGS. 4 and 5, the cushioning member 1 comprises a pair of sheets 5, 5' partially adhered together at 7 as by welding to form a plurality of spaced gel filled chambers 6 which are inflated by filling a gel 2 therein. The shape and arrangement of the filled chambers 6 should be determined according to the position of the cushioning member 1 and the kind of the shoes. For example, in the embodiment of FIGS. 1 and 2 which are running shoes, five small chambers 6 long sideways and arranged at the heel portion one behind the other, parallel to one another. These small chambers 6 are enclosed by an annular chamber 6. Six small chambers 6 are arranged behind the base of the fingers, one, two and three from inside to outside, as shown in FIG. 2. These chambers 6, too, are enclosed by an annular chamber 6.

The sheets 5, 5' should be made of a flexible material which can contain a gel without leakage, e.g. synthetic resin such as urethane, vinyl chloride and a copolymer consisting of urethane and vinyl chloride. As the gel 2, silicone gel having a rate of penetration of 50 to 100 may be used.

Figure 6:
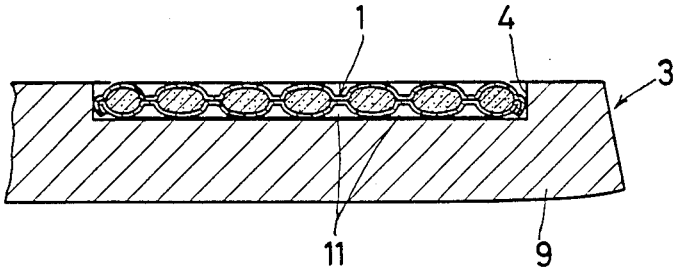
FIG. 6 is a sectional view of the cushioning member of FIG. 4 mounted in the recess formed in the sole plate.

The structure of the sole plate depends upon the kind of the shoes. In the case of running shoes as shown in Fig. 1, the sole plate 3 is a three-layer construction comprising an outer sole 8, a middle sole 9 and an upper sole 10. In this embodiment, the recesses 4 for receiving the cushioning members 1 are formed in the top surface of the middle sole 9. The recess 4 is of such a size that the cushioning member 1 is snugly received therein. The recess 4 is of a depth which is substantially the same as the thickness of the filled chambers 6 of the cushioning member 1. When the cushioning members 1 are set in the recesses 4, air chambers 11 are formed between the filled chamber 6 and the bottom of the recess 4 (FIG. 6).

The sole plate 3 may be made of e.g. rubber or ethylene vinyl acetate.

What are claimed are:

1. A shoe comprising a sole plate formed with a recess, and a shock absorbing cushioning member having a pair of sheets adhered together at spacings to form between said spacings a plurality of spaced gel filled chambers and an annular gel filled chamber around said spaced chambers, each of said gel filled spaced chambers and said annular gel filling chamber being filled with a non-elastically deformable gel, said recess being of a depth substantially equal to the thickness of said spaced gel filled chambers and said annular chamber, said cushioning member being received in said recess in said sole plate with air filled spaces between and surrounding said gel filled spaced chambers and said gel filled annular chamber, said gel filled chambers being deformed and said air in said air spaces between and surrounding said gel filled chambers being compressed when shock forces are applied to said cushioning member, said compressed air expanding and reforming said deformed gel filled chambers when said shock forces are repulsed.

2. A shoe sole as claimed in claim 1 wherein said sole plate comprises three plates put one upon another, the middle plate being formed with said recess.

3. A shoe sole as claimed in claim 1 in which said gel is a silicone gel.

4. A shoe sole as claimed in claim 2 in which said gel is a silicone gel.

* * * * *